United States Patent [19]

King et al.

[11] 4,064,676

[45] Dec. 27, 1977

[54] SKIN PACKAGING MACHINE WITH TRAVELLING VACUUM FRAME

[75] Inventors: George King, Stouffville, Canada; James V. Hannon, New Britain, Conn.

[73] Assignee: Pak-A-Matic, Inc., Berlin, Conn.

[21] Appl. No.: 795,080

[22] Filed: May 9, 1977

[51] Int. Cl.[2] ..... B65B 57/16; B65B 31/00

[52] U.S. Cl. ..... 53/77; 53/112 A

[58] Field of Search ..... 53/77, 112 A

[56] References Cited

U.S. PATENT DOCUMENTS

| | | | |
|---|---|---|---|
| 3,701,229 | 10/1972 | Zelnick | 53/112 A X |
| 3,958,394 | 5/1976 | Mahaffy et al. | 53/112 A |

*Primary Examiner*—Travis S. McGehee

[57] ABSTRACT

A relatively high speed packaging machine of the type in which a heated film is formed by application of pressure to provide an enclosure for encapsulation of articles on a substrate utilizes a conveyor, a heater and film transport means disposed above the conveyor. Pressure forming means and cutting means are movably supported on the frame for reciprocal movement along the frame and for movement vertically relative to the conveyor to effect forming of the film and cutting of the film into units. Drive means simultaneously drives the conveyor and film transport means as well as the pressure forming means and cutting means in movement towards the exit end of the conveyor. The drive means also returns the pressure forming means and cutting means and moves them in a vertical path relative to the conveyor. Control means operates the drive means to effect the times operation thereof while the conveyor moves continuously.

16 Claims, 13 Drawing Figures

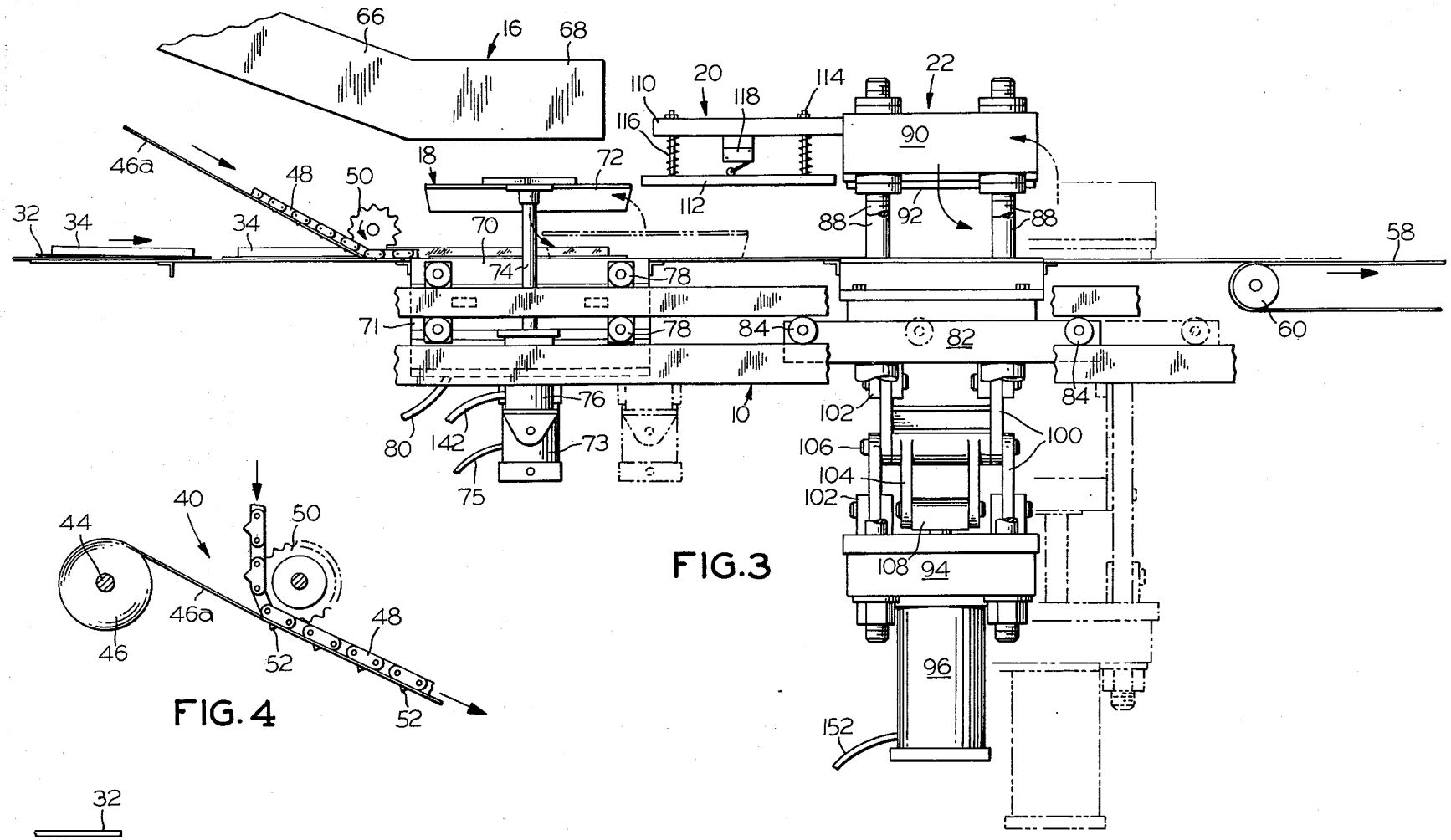
FIG. 3
FIG. 4
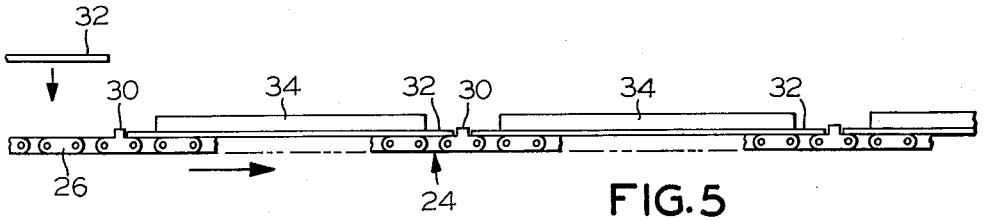
FIG. 5

SKIN PACKAGING MACHINE WITH TRAVELLING VACUUM FRAME

BACKGROUND OF THE INVENTION

Over the years, various machines have been developed for protective and/or display packaging of articles including skin packaging machines, curtain coating machines, blister packaging machines, and the like.

In blister packaging, the film is initially preformed abut a suitable die to provide a multiplicity of pockets which may or may not closely conform to the shape of the articles to be packaged. The thus formed film is cut into individual blisters which are then placed in a suitable platen providing receptacles therefor in the desired spaced realtionship, the articles to be packaged are placed in the blisters, and a cardboard substrate is bonded to the flanges of the blisters by adhesive, application of heat, or other suitable means. Finally, the substrate is cut about the individual blisters to provide the individual packages.

In skin packaging, the film is heated to the point of plasticity and is brought to a point closely adjacent the substrate and actually formed about the articles on the substrate and then bonded to the substrate. This produces a close fitting sheath and this bonding technique generally does not require a separate adhesive if the proper materials are employed. Although a number of machines have been developed to provide relatively high speed operations by providing both forming and cutting sections at separate stages in a single unit through which the substrates are conveyed automatically, most commercial machines have employed intermittent movement of the substrate to allow the forming and cutting operations to take place at fixed points along the path of travel of the substrate therethrough. Moreover, it has been proposed in some machines to have the clamping frame or a vacuum platen for forming the film move relative to the frame of the machine. Illustrative of machines intended to provide continious or semicontinuous high speed operation are those shown in U.S. Pat. Nos.:

| Patentee | Patent No. | Grant Date |
|---|---|---|
| Rorer | 3,377,770 | April 16, 1968 |
| Stone | 3,587,200 | June 28, 1971 |
| Parvin | 3,668,820 | June 13, 1972 |
| Canamero et al | 3,673,760 | July 4, 1972 |
| Tartarini | 3,902,302 | Sept. 2, 1975 |
| Reid | 3,930,350 | Jan. 6, 1976 |

As of the present time, there has been commercially available no packaging machine of the type wherein the substrates advance substantially continuously and the forming and cutting operations occur without interruption of the progress of the substrates through the packaging machine on the conveying means. Moreover, there has been no such machine in which the speed of advance and operation of the forming and cutting stages may be quickly and conveniently adjusted to compensate for different packaging materials and/or conditions.

It is an object of the present invention to provide a novel packaging machine for forming enclosures to encapsulate articles between a film and a substrate and wherein heating, forming and cutting stages are combined and operative as the film advances therethrough substantially continuously.

It is also an object to provide such a packaging machine in which the speed of advance and the speed of the forming and cutting operations may be readily and conveniently adjusted to compensate for variation in materials and/or packaging conditions.

Another object is to provide such a packaging machine in which advancement of components and forming and cutting operations are simultaneously conducted and controlled by simple and rugged adjustable drive and control means.

A further object is to provide such a packaging machine in which misalignment of skin packaged articles upon the substrate may be determined rapidly and conveniently prior to cutting stage.

SUMMARY OF THE INVENTION

It has now been found that the foregoing and related objects can be readily attained in a packaging machine of the type in which a heated film is formed by application of pressure to provide an enclosure for encapsulation of articles disposed on a substrate by a combination including a frame and a conveyor on the frame with means for advancing a substrate between an entrance end and an exit end. A heater is disposed above the conveyor at a point intermediate its length, and film support and transport means on the frame above the conveyor is adapted to advance the film from a point in advance of the heater, under the heater, and thence along and adjacent the conveyor towards the exit end.

Movably supported upon the frame for reciprocal movement along the conveyor from adjacent the heater to a point spaced towards the end end, is pressure forming means including means for forming the heated film by application of pressure. Cutting means is also movably supported on the frame for reciprocal movement along the conveyor spaced towards the exit end thereof.

Drive means on the frame synchronously drives the conveyor and film transport means and also the pressure forming means and cutting means in their movement towards the exit end of the conveyor. Following movement of the pressure forming means and cutting means in this direction, the drive means then returns these two means in the opposite direction to effect the reciprocal movement thereof. The drive means additionally causes the pressure forming means to engage the film to effect forming thereof and concurrently causes the cutting means to engage the film and effect severing thereof into units. After movement in the direction of the exit end of the conveyor, the drive means then effects release from engagement with the film of the forming means and cutting means to permit reciprocal movement in the opposite direction.

Control means operates the drive means to effect the engagement and disengagement of the pressure forming means and the cutting means and to effect movement of the pressure forming means and cutting means in the direction of the exit end of the conveyor upon engagement with the film, and movement in the opposite direction after disengagement from the film.

In accordance with the preferred embodiment of the invention, the pressure forming means includes a platen and a clamping frame with at least one of the platen and clamping frame being movable relative to the other and perpendicularly to the direction of movement of the conveyor. The drive means is connected to the movable element to effect the relative movement and the control means operates the drive means to effect such movement. Most usually, the clamping frame will be disposed above the platen and will be the movable one of the two elements of the pressure forming means. The platen is connected to suction means or a source of vacuum to draw the heated film downwardly towards the platen to effect forming thereof. When the machine is used for blister forming, the platen will comprise a die defining the configuration of the blisters and the film will be formed into conformity therewith. When the machine is used for skin packaging, the platen will support a substrate of cardboard or the like upon which articles are disposed in proper orientation and the vacuum will effect forming of the film into a sheath about the articles and bonding to the substrate.

In the preferred embodiment, the cutting means comprises the combination of a platen member and a blade member, the latter having a multiplicity of intersecting blade edges configured to sever the film into a multiplicity of sections. As in the case of the pressure forming means, one of the platen and blade members is movable relative to the other and perpendicularly to the direction of movement of the conveyor, and the drive means and control means are operable to effect the relative movement of the two members. Most usually, the blade member will be disposed above the platen member and will be the movable one of the two members. In its most desirable aspect, the blade member is supported for vertical movement on a plurality of vertical guide posts to maintain parallelism of the opposed faces of the platen and blade members.

In its preferred aspect, the machine includes means coupling the pressure forming means and cutting means to effect simultaneous reciprocal movement thereof. The conveyor includes a plurality of endless chain members spaced apart transversely of the frame and configured to convey substrates along the length thereof from the entrance end to the exit end. These chain members desirably have upstanding fingers spaced along the length thereof to receive the substrates therebetween and propel the substrates therealong.

Similarly, the film support and transport means desirably includes a plurality of endless members rotatably mounted on the frame and pins projecting from the endless members to penetrate the film and thereby effect engagement thereof to transport the film. The endless members conveniently comprise chains and transport the film closely adjacent the conveyor along at least a portion of the length thereof defined by the location of the perssure forming and cutting means. The film support means includes means on the frame for supporting a roll of film above the conveyor at a point spaced from the heater towards the entrace end of the conveyor.

In its preferred aspect, the machine includes article sensing means spaced between the pressure forming means and cutting means and adapted to determine the presence of articles in proper disposition upon a substrate when the machine is being used as a skin packaging machine. Electric circuit means is coupled to the control means to terminate operation of the drive means in the event of misplaced articles on the substrate. This article sensing means is movable perpendicularly relative to the conveyor and is reciprocable along the length of the conveyor together with the pressure forming means and cutting means.

BRIEF DESCRIPTION OF THE DRAWINGS

FIG. 3 is a fragmentary side elevational view to an enlarged scale of the heating, pressure forming and cutting stations of the machine with arrows indicating the directions of movement of the pressure forming and cutting stages as well as the movement of film and substrates therethrough and showing the alternate portions of elements in phantom line;

FIG. 4 is a fragmentary side elevational view to a still further enlarged scale showing a section of the film storage and transport assembly;

FIG. 5 is a fragmentary side elevational view to the same scale of the chain drive in the conveyor portion of the apparatus at the feed end thereof and showing articles supported on some substrates;

DETAILED DESCRIPTION OF THE ILLUSTRATED EMBODIMENTS

Figure 2:
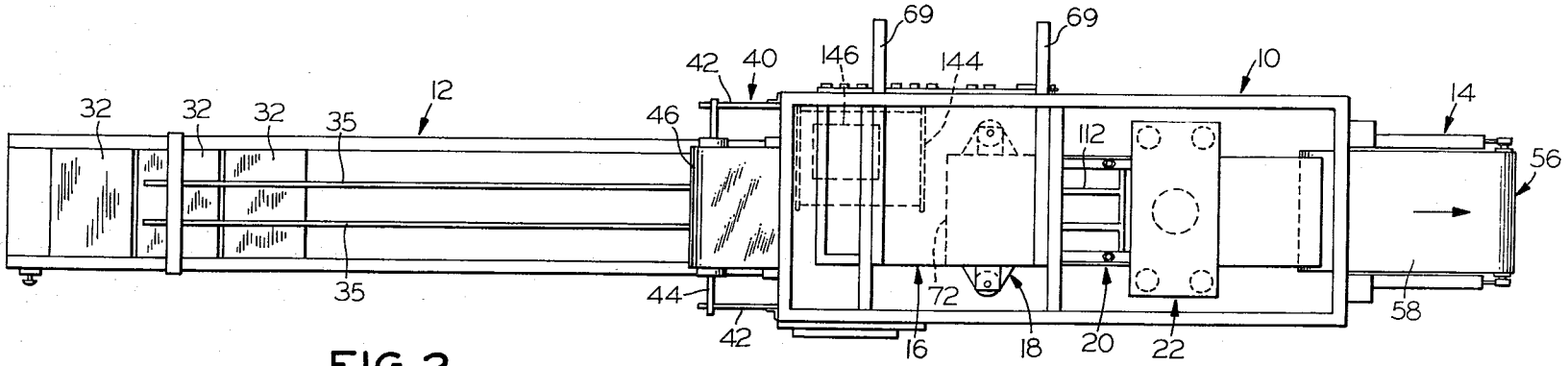
FIG. 2 is a top elevational view thereof with concealed portions shown in dotted line.
Figure 1:
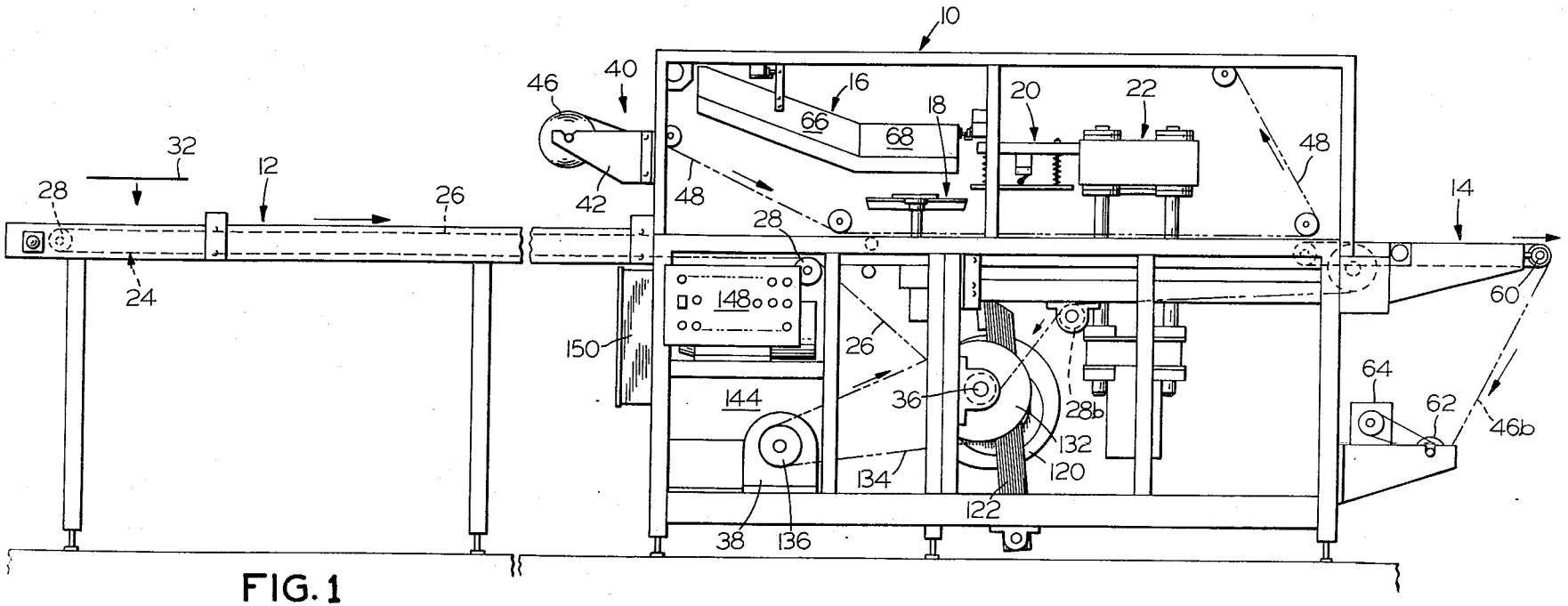
FIG. 1 is a side elevational view of a skin packaging machine embodying the present invention with the path of movement of the drive chains shown by the arrows and with various concealed portions thereof shown in dotted line.

Turning now in detail to FIGS. 1 and 2 of the attached drawings, a skin packaging machine embodying the present invention utilizes a frame assembly comprised of the main frame generally designated by the numeral 10, the feed extension frame generally designated by the numeral 12, and the discharge extension frame generally designated by the numberal 14. Supported in the main frame 10 in fixed position is the heater assembly generally designated by the numeral 16, and supported therewithin for reciprocal and relative vertical movement of the components thereof are the pressure forming assembly generally designated by the numeral 18, the product sensing assembly generally designated by the numeral 20, and the cutting assembly generally designated by the numeral 22.

As seen in FIGS. 1–3, 5 and 12, the machine includes a substrate conveyor generally designated by the numeral 24 and comprised of a pair of endless chains 26 which extend about sprockets 28 rotatably carried by shafts journaled in the frame portions 10,12,14. As best seen in FIG. 5, elements of the chains 26 include upstanding fingers 30 which provide an abutment for the trailing edge of substrates 32 being carried thereby to effect propulsion thereof through the machine and which also serve to locate the substrates 32 in the desired position and spacing upon the conveyor 24. The spacing between the fingers 30 can be varied but generally will approximate the width of the operative portions of the pressure forming and cutting assemblies 18,22. In FIG. 5, elongated articles 34 to be packaged are shown disposed upon the upper surface of the substrates 32 and a substrate 32 is shown diagramatically as it is about to be placed upon the conveyor 24 on the feed end of the frame 12 of the machine.

Figure 10:
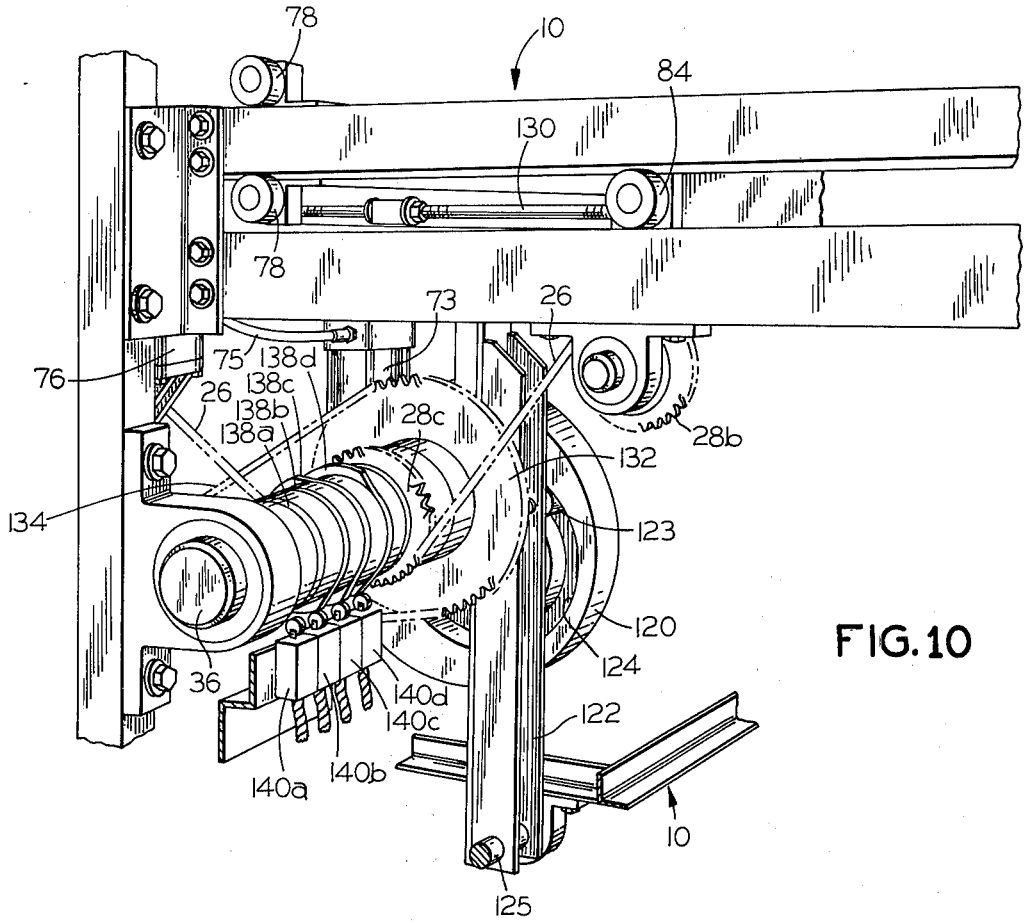
FIG. 10 is a fragmentary perspective view to an enlarged scale of the main drive and timing cam assemblies.
Figure 12:
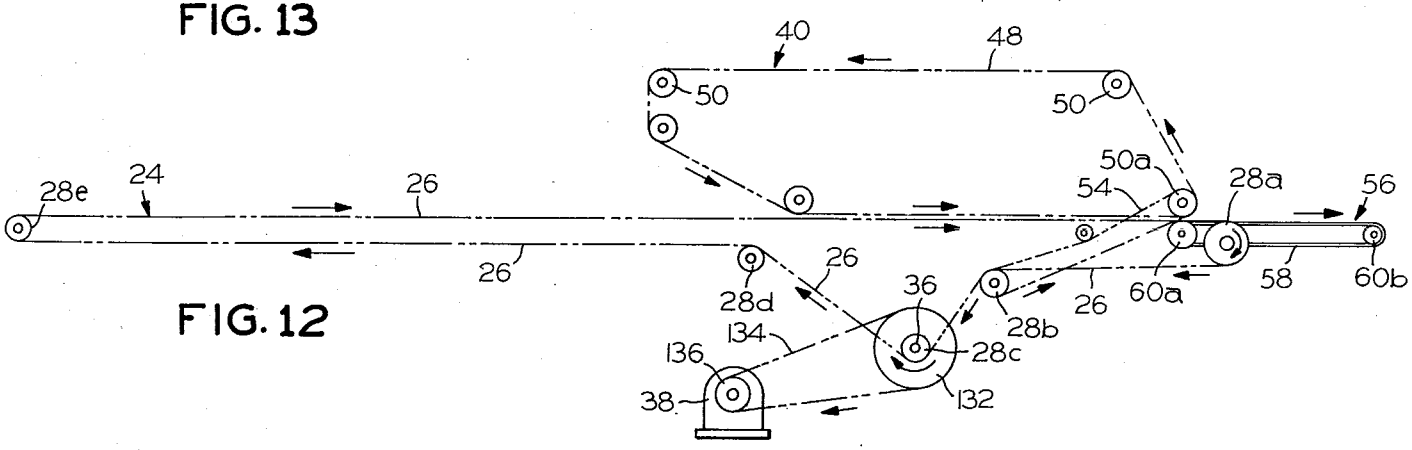
FIG. 12 is a diagrammatic view showing the paths of movement of the chains of the conveying apparatus and film transport apparatus and the drive connections to the main drive motor.

As can be seen in FIG. 12, the chains 26 extend in a substantially horizontal path from the feed to adjacent the discharge end of the machine, pass about the sprockets **28*a* and 28*b* and thence about the sprocket 28*c* of the main drive shaft 36 before returning to a substantially horizontal path defined by the sprockets 28*d* and 28*e* to the feed end of the machine. As seen in FIGS. 2, 10 and 12, the main drive shaft 36 is in turn driven by the variable speed motor 38**.

As seen in FIG. 1, the film support and transport system is generally designated by the numeral 40 and includes a pair of brackets 42 carried by the upper portion of the main frame 10 and which rotatably support the shaft 44 upon which the roll of film 46 is carried. As shown in FIGS. 1, 4 and 12, the film support and transport system 40 additionally includes a pair of chains 48 which pass about sprockets 50 and which have pins 52 projecting therefrom to pierce and thereby drivingly engage the film **46*a* to advance it through the machine. The sprocket 50*a* is driven by the chain 54 which derives its motive power from the sprocket 28*b*. Thus, the chains 26 of the substrate conveyor 24 and the chains 48 of the film support and transport system 40 are driven simultaneously by the variable speed motor 38**.

As best seen in FIG. 12, a discharge conveyor generally designated by the numeral 56 comprises an endless belt 58 extending about the rollers **60*a*, 60*b*, with the roller 60*a* having sprockets thereon (not shown) so as to be driven by the chains 26. As will be described more fully hereinafter, the web of film 46*b* remaining after the packages have been severed and stripped therefrom passes downwardly from the roller 60*b* and is wound upon the takeup roller 62 which is driven by the motor 64 at a speed substantially equal to the speed of the conveyor 24 and of the film support and transport system 40**.

As seen in FIGS. 1 and 3, the heater assembly 16 has a portion 66 which is inclined upwardly towards the feed roll 46 and is spaced upwardly from the film **46*a* as it is conveyed through the machine by the chains 48. Spaced above the pressure forming assembly 18, the heater assembly includes a horizontal portion 68 so that the film 46*a* is heated over a path of travel prior to the pressure forming assembly 18 and at the pressure forming assembly 18. It can be moved to one side of the frame 10 upon the side arms 69** upon which it is slidably supported.

Turning now to FIGS. 3 and 7–9, the pressure forming assembly 18 includes a platen 70 which is supported on the carriage 71 which is carried upon the main portion of the frame 10 by the rollers 78 to permit its reciprocation therealong. The upper surface of the platen 70 is spaced closely adjacent the chains 26 of the substrate conveyor 24 so that the substrates 32 move along the upper surface thereof. To elevate the platen 70 with a blister forming die thereon (not shown) relative to the carriage 71 for forming of the film **46*a* in a blister forming mode, the piston cylinder 73 is mounted upon the carriage 71 and its rod (not shown) acts upon the platen 70. The clamping frame 72 is supported above the chains 26 of the substrate conveyor 24 upon the rods 74 of the pistons 76 which are carried upon the platen 70, and the ends of the rods 74 seat in the horizontally projecting brackets 77 of the frame 72. The platen 70 is connected to a source of vacuum by the flexible hose 80 so that, when the film is clamped tightly between the clamping frame 72 and the platen 70 and vacuum is drawn through the small holes (not shown) in the platen 70, the film 46*a* will be drawn tightly about the articles being skin packaged during skin packaging, or about the surfaces of the mold when the machine is being used for blister forming. Thus, in operation, the entire pressure forming assembly 18 reciprocates along the length of the conveyor 24 within the main frame 10, and the clamping frame 72 reciprocates vertically of the path of movement of the conveyor 24 relative to the platen 70**.

Figure 6:
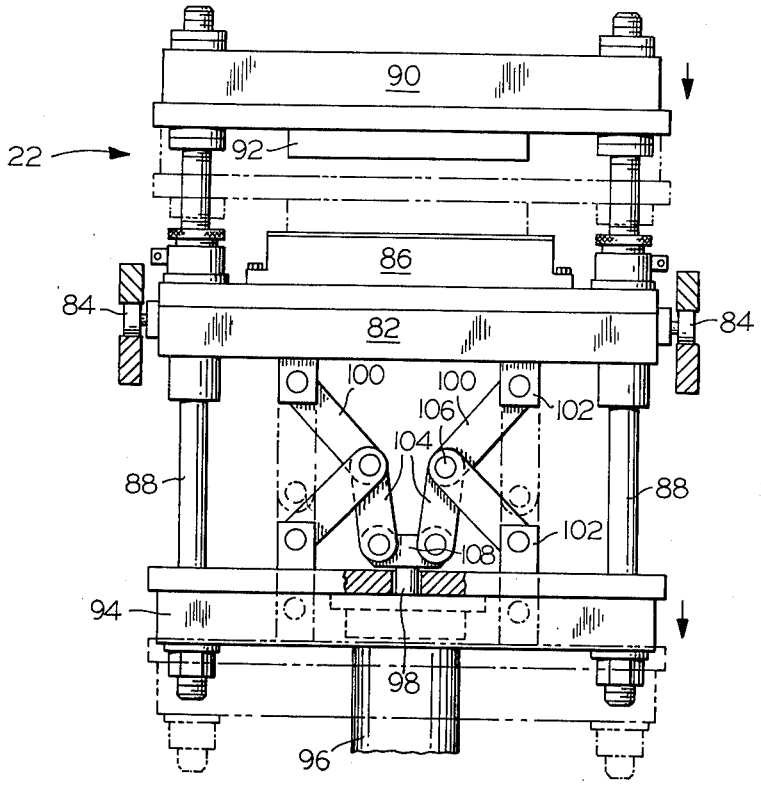
FIG. 6 is a fragmentary end elevational view of the cutting assembly with the components shown in solid line in the open position and in phantom line in the cutting position.
Figure 7:
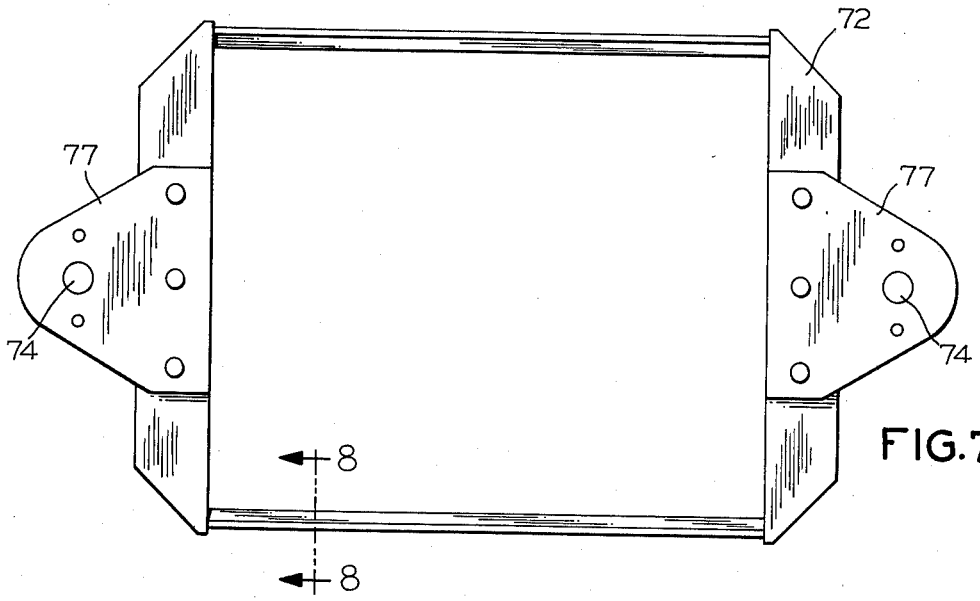
FIG. 7 is a top view to an enlarged scale of the clamping frame of the pressure forming station.
Figure 8:
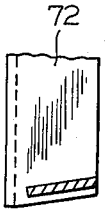
FIG. 8 is a fragmentary sectional view of the clamping frame along the line 8—8 of FIG. 7.
Figure 9:
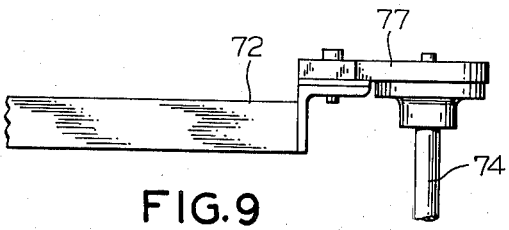
FIG. 9 is a fragmentary side elevational view of the clamping frame showing fragmentarily a piston rod attached to the frame.

Spaced towards the exit end of the conveyor 24 from the pressure forming assembly 18 is the cutting assembly 22 which is best seen in FIGS. 3 and 6. The carriage 82 is mounted upon the main frame 10 by rollers 84 for reciprocal movement along the length of the substrate conveyor 24 and supports thereon the bed platen 86. In addition, the four corners thereof have slidably mounted therein four vertically extending rods 88 which carry on the upper end thereof the movable member 90. Supported on the lower surface of the movable member 90 is the die cutting member 92 which cooperates with the bed platen 86 to effect severing of the film **46*a*** and substrates in accordance with the pattern of knife edges therewithin.

Mounted on the lower ends of the rods 88 is the piston support member 94 which carries the piston cylinder 96 centrally thereof with its piston rod 98 projecting thereabove. Two pairs of toggle arms 100 are connected between opposed ears 102 on the upper surface of this piston support member 94 and the lower surface of the carriage 82, and drive arms 104 are pivotally connected between the center pivot 106 and ears 108 on the upper end of the piston rod 98. Thus, when the piston rod 98 is moved outwardly of the cylinder 96, the drive arms 104 act against the center pivot 106 of the toggle arms 100. This action causes them to straighten under the applied pressure forcing the piston support member 94 downwardly and concurrently moving the movable member 90 and its die cutting member 92 downwardly against the bed platen 86 which is supported upon the carriage 82. The downwardly moved position is shown in phantom line in FIGS. 3 and 6. Movement of the piston rod 98 into the piston cylinder 96 causes the drive arms 104 to act to collapse the toggle arms 100 into the position shown in solid line and thus move both the piston support member 94 and the movable member 90 upwardly relative to the carriage 82 to the original position shown in solid line.

Supported on the movable member 90 of the cutting assembly 22 in the space between it and the pressure forming assembly 18 is the product sensing assembly 20 which includes arms 110 projecting from the movable member 90 and a sensing plate 112 spaced therebelow and carried upon the spacers 114 which are slideably mounted in the arms 110. Springs 116 disposed about the spacers 114 between the arms 110 and the sensing plate 112 bias the sensing plate 112 downwardly. A limit switch 118 is disposed therebetween and is acted upon in the event that the sensing plate 112 is pushed upwardly against the action of the springs 116 as a result of its encountering a product upon a substrate which is not in proper alignment with the contour of the face thereof.

Figure 11:
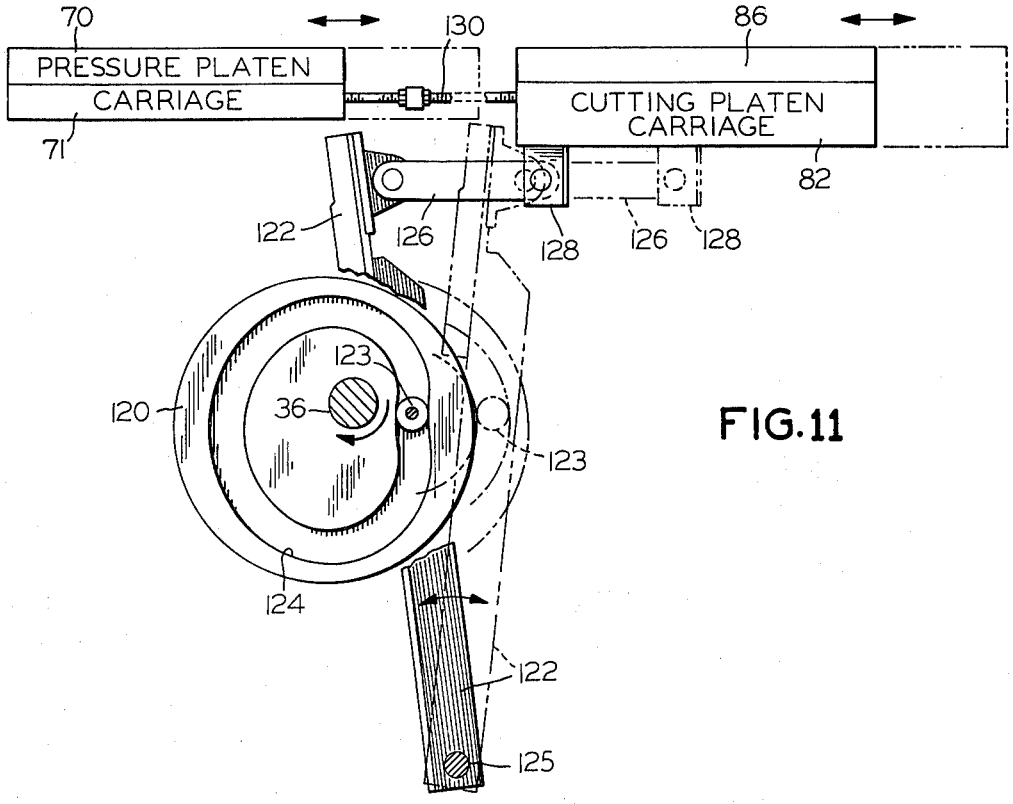
FIG. 11 is a fragmentary, partially diagrammatic side elevational view of the forming platen and cutting platen as coupled to each other and to the main drive cam with the reciprocal movement shown by the doubled ended arrows and with the cam follower arm shown in the initial position in solid line and in the exit end position in phantom line.

As seen in FIGS. 10 and 11, the reciprocal movement of the pressure forming platen 70 and the cutting assembly carriage 82 is effected by the eccentric cam 120 which acts upon the cam follower arm 122 with its roller 123 riding in the cam track 124 thereof. The cam follower arm 122 is pivoted at one end on the shaft 125 to the frame and at the other end to one end of a drive link 126 which is pivotally engaged at its other end to a depending leg 128 on the cutting assembly carriage 82. The pressure forming platen 70 and cutting assembly carriage 82 are interconnected by the connector rods 130 to effect simultaneous reciprocal movement thereof from the intial position as shown in full line to the discharge position shown in phantom line and then returned to the intial position.

As best seen in FIG. 10, the cam 120 is rotatably supported by the main drive shaft 36 which also carries the drive sprocket 132. Rotation of the drive shaft 36 is effected by the motor 38 through the drive chain 134 which extends about the drive sprocket 132 and the motor sprocket 136.

As previously indicated, the chains 26 of the substrate conveyor 24 extend about the sprocket **28*c* on the drive shaft 36 so as to derive motive power therefrom and the chains 26 impart motive power to the sprocket 28*b* and thereby to the drive chain 54 (not shown in FIG. 10) for the chains 48 of the film support and transport system 40**.

Also carried upon the drive shaft 36 are the timing cams **138*a*, 138*b*, 138*c*, 138*d* which actuate the switches 140*a*, 140*b*, 140*c*, 140*d* which are mounted upon the frame 10 for a purpose to be described more fully hereinafter. Thus, as the drive shaft 36 rotates, it effects simultaneous movement of the chains 26 of the substrate conveyor 24, the chains 48 of the film support and transport system 40, the reciprocal movement of the cutting assembly carriage 82 and the pressure forming platen 70, and it operates in adjustable controlled time sequence the several switches 140*a*, 140*b*, 140*c*, 140*d*. The switches 140 in turn effect operation of the vertical movement of the elements of the pressure forming assembly 18 and cutting assembly 22**.

Also seen in FIG. 10 is a hose 142 which supplies high pressure air to the piston cylinder 76 which effects the vertical movement of the clamping frame 72 relative to the platen 70. This hose 142, the hose 75 for the piston cylinder 73, and hose 152 for the piston cylinder 96 are connection to a source of air under pressure (not shown) which is operative to supply air therethrough upon opening of valves (not shown).

As seen in FIGS. 1 and 2, the machine includes a vacuum tank 144 which is connected to the platen 70 by the vacuum hose 80 shown in FIG. 3 and in turn is itself connected to the vacuum pump 146. The electrical control panel 148 includes the switches, push buttons and indicator lights relative to operation of the machine and the bulk of the electrical controls are disposed within the control box 150.

Figure 13:
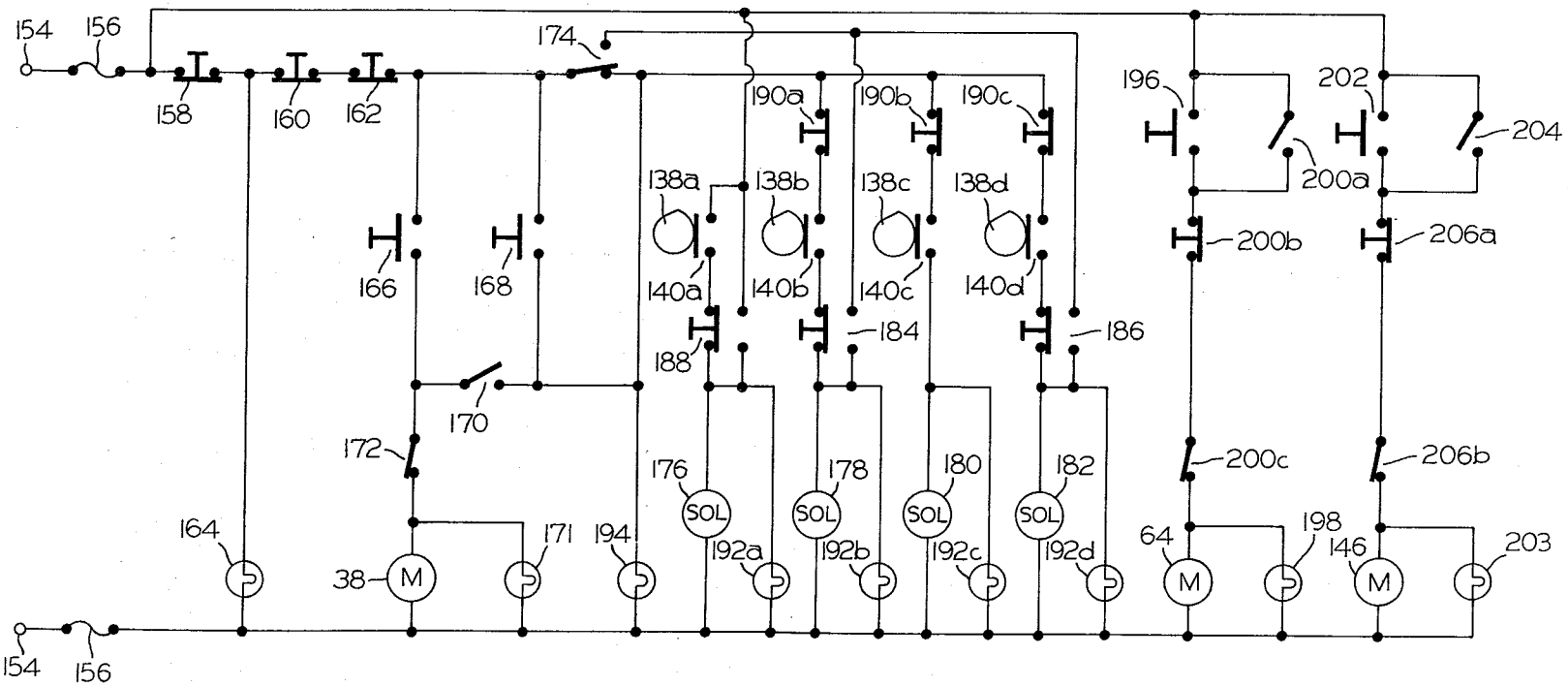
FIG. 13 is a circuit diagram for the control circuit of the machine.

Turning now to FIG. 13, therein illustrated diagramatically are the various elements of the control and timing circuit for operation of the several components. The control and timing circuit is connected to a suitable source of line voltage through the contacts 154 and each leg is protected by a fuse 156. An emergency "off" switch 158 permits total termination of operation, and normal operation requires that both switches 160, 162 be closed. When these several switches are closed, the indicator light 164 is illuminated.

The main drive motor 38 can be actuated for short jogs by the momentary switch 166 or put in continuous operation by the start switch 168, and motor operation is shown by the indicator light 171. Operation of the main drive motor 38 when the start switch 168 is closed can be terminated abruptly by opening of either of the emergency swtiches 170, 172, one of which may correspond to or be actuated by the switch 118 of the product sensing assembly 20.

Vertical movement of the components of the pressure forming assembly 18 and cutting assembly 22 can be effected automatically when the switch 174 is in the indicated position and manual operation is effected when the switch 174 is in its alternate position. As the timing cam **138*a* rotates, it causes the switch 140*a* to actuate the solenoid 176 if the manual switch 188 is in the illustrated blister packaging position, and this moves the platen 70 with its forming die (not shown) upwardly against the film 46*a*. During skin packaging use, the microswitch 140*a* is inoperative since the platen 70 remains in its position on top of its carriage 71. In timed relationship, the timing cam 138*b* closes the microswitch 140*b* which actuates the solenoid 178 to supply air to the piston cylinder 76 and move the clamping frame 72 downwardly against the platen 70**.

Also in timed relationship, the timing cam **138*c* closes the switch 140*c* which actuates the solenoid valve 180 to connect the platen 70 to the vacuum tank 144 and thereby suck the heated film 46*a* downwardly against the platen 70. Concurrently, the timing cam 138*d* is rotating and, in proper timed sequence, effects closing of the switch 140*d* to open the solenoid valve 182 which supplies air to the piston cylinder 96 to effect the downwardly movement of the movable member 90 against the bed platen 86 and thereby cutting of the film 46*a* (and substrate 32**).

As the timing cams 138 continue to rotate, the switches 140 open and the solenoid valves 176, 178, 180, 182 open, release the vacuum being drawn through the platen 70 and release the supply of pressurized air to the piston cylinders 73, 76 and 96 to move the platen 70 downwardly and the clamping frame 72 and movable member 90 to their disengaged uppermost positions.

Manual operation of the solenoid valves 178 and 182 can be effected by moving the switches 174, 184, 186 from the position shown to close the alternate sets of contacts. Movement of the switch 188 to its alternate position transforms the operation from a blister packaging to a skin packaging operation wherein the platen 70 is stationary upon its carriage 71.

"On/Off" switches **190*a*, 190*b*, 190*c* permit disabling of any one of the solenoids 178, 180, 182 when the switch 174 is in the automatic position shown in the drawings. Indicator lights 192*a*, 192*b*, 192*c*, 192*d* indicate that power is being supplied to the respective solenoids. Indicator light 194 indicates that the clamping frame 72** is activated to closing or clamping position.

The rewind motor 64 is actuated by closing the start switch 196 and its operation is indcated by the indicator light 198. The switch **200*a*** permits bypassing the switch 196 and auxiliary switches in the circuit 200*b*, 200*c*, are safety switches to terminate operation of the motor 64.

Lastly, the vacuum pump 146 is actuated by closing the start switch 202 and this operation is indicated by the indicator light 204. The start switch 202 may be bypassed by the switch 204 and the pump's operation may be terminated by the emergency switches 206*a* and 206*b*.

Turning now to the operation of the illustrated embodiment, the substrates 32 are placed between the upstanding fingers 30 of the chains 26 of the substrate conveyor 30 at the feed end of the machine, and the articles 34 to be skin packaged are placed upon the upper surface of the substrates 32 in a predetermined position. As seen in FIG. 2, guides 35 may be provided upon the feed extension 12 of the frame to facilitate loading of the articles 34 upon the substrates 32 in predetermined position. The loaded substrates 32 then progress along the substrate conveyor 24 into the area of the main frame 10.

Concurrently with the advance of the loaded substrates 32, film 46*a* is being drawn from the roll 46 by the film transport chains 48 which pierce the film 46*a* to effect the driving engagement therewith. As the film 46*a* is moved along its path, it is subjected to heat from the heater assembly 16 to raise it to the desired temperature where it exhibits the plasticity required for the forming operation.

As the film 46*a* reaches a point beneath the clamping frame 72, it closely overlies the articles 34 upon the substrates 32. The clamping frame 72 is rapidly moved downwardly to seal the periphery of the film 46*a* against the surface of the substrate 32 which is itself disposed upon the upper surface of the platen 70. Vacuum is drawn through the hose 80 and thence through the platen 70 which evacuates the air from under the film 46*a* to draw it tightly about the articles 34 upon the substrate 32 to form sheaths therefor, and the film 46*a* is concurrently bonded to the surface of the substrate 32. During this action, the platen 70 and clamping frame 72 are moving towards the discharge end of the machine along with the film 46*a* and substrates 32 by the action of the cam follower arm 122 which is acting directly upon the cutting platen carriage 82 and indirectly on the platen 70 through the connecting rods 130.

After the limited movement in the direction of the feed end, the piston cylinder 76 is supplied air through the hose 142 to elevate the piston rod 74 and thereby the clamping frame 72 while at the same time the cam follower arm 122 is reciprocating the platen 70 in the direction of the feed end. Since the sking packaging assembly now formed by the bonded film 46*a* and substrate 32 continue to be propelled in the direction of the discharge end of the machine by the chains 24 and 48, the skin packaging assembly is in alignment with the product sensing assembly 20 during the next downward movement cycle of the clamping frame 72 and movable member 90 of the cutting assembly 22. As the product sensing assembly 20 descends, the sensing plate 112, which is configured to receive the articles 34 into the cavities in the body thereof, comes into contact with the skin packaging assembly. If the articles 34 are in proper position, it moves downwardly freely to its lowermost position; if the articles 34 are misaligned, they will not freely move into the recesses in the face of the sensing plate 112 and will cause it to move upwardly against the action of the springs 116 to actuate the limit switch 118 which will immediately terminate operation of the machine since misplaced articles 34 could seriously damage the die cutting member 92 of the cutting assembly 22.

It can be seen that the product sensing assembly 20 reciprocates in the direction of the discharge end of the machine concurrently with the cutting assembly 22 and pressure forming assembly 18 since it is directly supported upon the cutting assembly 22. As the movable member 90 of the cutting assembly 22 is moved upwardly, the product sensing assembly 20 moves concurrently upwardly so that the skin packagaing assembly now registers with the cutting assembly 22 in its position towards the feed end of the machine.

Air under pressure supplied to the piston cylinder 96 quickly brings the movable member 90 and its die cutting member 92 downwardly against the skin packaging assembly and the blade edges of the die cutting member 92 sever the film 46*a* and substrate 32 into unit packages. When the air cylinder 96 effects movement of the movable member 90 to its upper position and the cutting assembly 22 reciprocates towards the feed end of the machine, the web 46*b* of the and the unit packages continue towards the discharge end of the machine. The unit packages travel onto the conveyor belt 58 where they are stripped from the film either manually or automatically by apparatus not shown, and the web 46*b* of the film passes downwardly about the roller 60 and is wound upon the takeup roller 62 by action of the motor 64.

Operation of the machine as a blister forming machine is generally as heretofore outlined except that the platen 70 is provided with male (or female) die forms about which the heated film is formed under action of the applied vacuum. As the film is heated, the piston 73 moves the platen die surface upwardly and the clamping frame 72 is moved downwardly by the pistons 76. After formation of the film 46*a* into the desired configuration, the clamping frame 72 is elevated and the film 46*a* is stripped from the mold surfaces by movement of the platen 70 downwardly as it continues to advance to the cutting assembly 22. In this embodiment of operation, the product sensing assembly 20 is not required. In the cutting assembly 22, the formed sections of the film 46*a* are severed into units and they are then stripped from the discharge conveyor 56 while the web 46*b* is wound about the takeup roller 62.

It will be appreciated that variations may be made in the various components of the machine. However, the illustrated embodiment has been found rugged and highly reliable in operation. Although chains have been shown as the drive means for both the substrates and the film, belts or other continuous members providing means for effecting satisfactory engagement with the film and the substrates may be employed. Similarly, various heater configurations may be substituted for that indicated and other embodiments of platen and clamping frames may also be utilized.

If so desired, the movable member of the cutting assembly may be moved downwardly in a manner to provide a rocking action to facilitate the cutting operation, as for example, by providing two pistons operating slightly out of phase to effect initial contact on one side of the substrate first.

It will be appreciated that the timing of the speed of advance through the machine can be readily adjusted by reason of the variable speed motor. However, a motor with a fixed speed can be utilized through suitable transmission mechanism which will permit variation in output speed. The timing cams operated by rotation of the cam drive shaft ensure proper timed sequence of the vertical movement of the several components. It is not essential that both the cutting assembly and the pressure forming assembly disengage at the same time and, as a practical matter, the faster action of the cutting assembly permits its earlier opening.

Thus, it can be seen from the foregoing detailed specification and attached drawings that the packaging machine of the present invention permits continuous high speed forming of heated film to provide enclosures for packages. Its components are rugged so as to provide long-lived operation and its speed of operation may be adjusted depending upon the materials being employed and the packaging conditions prevailing. Moreover, since all drive operations are derived from the single drive shaft, simple and effective close control of the timing sequence of operations may be effected and maintained.

We claim:

1. In a packaging machine of the type in which a heated film is formed by application of pressure to provide an enclosure for encapsulation of articles disposed on a substrate, the combination comprising:

a. a frame;

b. a conveyor on said frame and including means for advancing substrates between an entrance end and an exit end;

c. a heater disposed above said conveyor at a point intermediate its length;

d. film support and transport means on said frame above said conveyor for advancing film from a point in advance of said heater, under said heater and thence along and adjacent said conveyor;

e. pressure forming means movably supported on said frame for reciprocal movement along said conveyor from adjacent said heater to a point spaced therefrom and including means for forming the heated film by application of pressure;

f. cutting means movably supported on said frame for reciprocal movement along said conveyor adjacent said exit end thereof;

g. drive means synchronously driving said conveyor and film transport means and also said pressure forming means and said cutting means in their movement toward said exit end of said conveyor, said drive means returning said pressure forming means and cutting means in the opposite direction, said drive means further causing said pressure forming means to engage the film to effect forming thereof and causing said cutting means to engage the film to effect severing thereof into units, and said drive means effecting release of the engagement of the forming means and cutting means after movement in the direction of the exit end of said conveyor for reciprocal movement in the opposite direction; and h. control means for operating said drive means to effect engagement and disengagement of said pressure forming means and cutting means and to effect movement of said pressure forming means and cutting means in the direction of said exit end upon engagement and movement in the opposite direction after disengagement.

2. The packaging machine in accordance with claim 1 wherein said pressure forming means includes a platen and a clamping frame, at least one of said platen and clamping frame being movable relative to the other perpendicularly to the direction of movement of said conveyor, said drive means being connected to the movable one of said platen and clamping frame to effect said relative movement, and said control means operating said drive means to effect said relative movement.

3. The packaging machine in accordance with claim 2 wherein said clamping frame is disposed above said platen and is the movable one of said members.

4. The packaging machine in accordance with claim 2 wherein said platen is connected to suction means to draw the heated film downwardly towards the platen to effect forming thereof.

5. The packaging machine in accordance with claim 1 wherein said cutting means includes a platen member and a blade member having a multiplicity of intersecting blade edges therein to sever the film into a multiplicity of sections, one of said platen member and blade member being movable relative to the other perpendicularly to the direction of movement of said conveyor, said drive means being connected to the movable one of said platen member and blade member to effect said relative movement, and said control means operating said drive means to effect said relative movement.

6. The packaging machine in accordance with claim 5 wherein said blade member is disposed above the platen member and is the movable one of said members.

7. The packaging machine in accordance with claim 6 wherein said blade member is supported for such relative vertical movement on a multiplicity of vertical guide posts to maintain parallelism of the opposed faces of said platen member and blade member.

8. The packaging machine in accordance with claim 1 wherein said machine includes means coupling said pressure forming means and cutting means for simultaneous reciprocal movement.

9. The packaging machine in accordance with claim 1 wherein said conveyor includes a plurality of endless chain members spaced apart transversely of said frame and rotatably mounted on said frame to convey substrates along the length thereof.

10. The packaging machine in accordance with claim 9 wherein said endless chain members have upstanding fingers spaced along the length thereof to receive the substrates therebetween and propel the substrates therealong.

11. The packaging machine in accordance with claim 1 wherein said film support and transport means includes a plurality of endless members rotatably mounted on said frame and having pins projecting therefrom to penetrate the film and thereby effect firm engagement thereof.

12. The packaging machine in accordance with claim 11 wherein said endless members comprise chains.

13. The packaging machine in accordance with claim 11 wherein said endless members transport the film closely adjacent said conveyor at least along a portion of the length thereof.

14. The packaging machine in accordance with claim 1 wherein said film support and transport means includes means for supporting a roll of film on said frame above said conveyor at a point on said frame spaced from said heater towards the entrance end of said conveyor.

15. The packaging machine in accordance with claim 1 wherein said machine includes article sensing means spaced between said pressure forming means and cutting means adapted to determine the presence of articles in proper disposition on a substrate, and electrical circuit means coupled to said control means for termination of operation of said drive means in the event of misplaced articles on said substrate.

16. The packaging machine in accordance with claim 15 wherein said article sensing means is movable perpendicular relative to said conveyor and reciprocable along the length of said conveyor together with said pressure forming means and cutting means.

* * * * *